US010495040B2

(12) United States Patent
Legrand

(10) Patent No.: US 10,495,040 B2
(45) Date of Patent: Dec. 3, 2019

(54) CONTROL VALVE ASSEMBLY

(71) Applicant: DELPHI TECHNOLOGIES IP LIMITED, St. Michael (BB)

(72) Inventor: Philippe Legrand, St. Gervais la Foret (FR)

(73) Assignee: DELPHI TECHNOLOGIES IP LIMITED (BB)

( * ) Notice: Subject to any disclaimer, the term of this patent is extended or adjusted under 35 U.S.C. 154(b) by 53 days.

(21) Appl. No.: 15/533,167

(22) PCT Filed: Oct. 29, 2015

(86) PCT No.: PCT/EP2015/075072
§ 371 (c)(1),
(2) Date: Jun. 5, 2017

(87) PCT Pub. No.: WO2016/091451
PCT Pub. Date: Jun. 16, 2016

(65) Prior Publication Data

US 2017/0328319 A1 Nov. 16, 2017

(30) Foreign Application Priority Data

Dec. 11, 2014 (GB) ..... 1421995.0

(51) Int. Cl.
*F02M 47/02* (2006.01)
*F02M 63/00* (2006.01)

(52) U.S. Cl.
CPC ..... *F02M 47/027* (2013.01); *F02M 63/0071* (2013.01); *F02M 63/0078* (2013.01); *F02M 2200/16* (2013.01)

(58) Field of Classification Search
CPC ..... F02M 47/027; F02M 63/0071; F02M 2200/16
See application file for complete search history.

(56) References Cited

U.S. PATENT DOCUMENTS

| | | | | |
|---|---|---|---|---|
| 6,085,719 | A | 7/2000 | Heinz | |
| 2009/0205614 | A1 | 8/2009 | Hlousek et al. | |
| 2009/0320801 | A1* | 12/2009 | Ricco | F02M 47/027 123/472 |
| 2011/0272499 | A1 | 11/2011 | Venkataraghavan et al. | |
| 2014/0353537 | A1 | 12/2014 | Enters et al. | |

FOREIGN PATENT DOCUMENTS

| | | | |
|---|---|---|---|
| DE | 10 2009 045 168 | A1 | 3/2011 |
| EP | 2 778 386 | A1 | 9/2014 |
| JP | 2000164424 | A | 6/2000 |
| JP | 2003214280 | A | 7/2003 |

* cited by examiner

*Primary Examiner* — P. Macade Nichols
(74) *Attorney, Agent, or Firm* — Joshua M. Haines

(57) ABSTRACT

A subassembly for a high pressure fuel injector control valve includes a control valve member and a sleeve attached to a stem of the control valve member, the sleeve extending along at least a partial axial length of the stem of the control valve member, and wherein a clearance, provided between the sleeve and the control valve member, is in fluid communication with the control chamber such that during use, pressure compensation occurs, as the sleeve is caused to expand and seal against the control valve bore, thereby preventing leakage of fuel within the control valve assembly.

20 Claims, 8 Drawing Sheets

CONTROL VALVE ASSEMBLY

CROSS REFERENCE TO RELATED APPLICATIONS

This application is a national stage application under 35 USC 371 of PCT Application No. PCT/EP2015/075072 having an international filing date of Oct. 29, 2015, which is designated in the United States and which claimed the benefit of GB Patent Application No. 1421995.0 filed on Dec. 11, 2014, the entire disclosures of each are hereby incorporated by reference in their entirety.

TECHNICAL FIELD

This invention relates to a control valve for use in a fuel injector, and in particular to a control valve assembly for use in a fuel injector in a high pressure diesel injection system for an internal combustion engine.

BACKGROUND OF THE INVENTION

A known fuel injector 1, as illustrated in FIG. 1, comprises an injector body 60, an injector nozzle 62 and a movably mounted injector needle 64. A spring 66 is provided in a spring chamber 68 for biasing the injector needle 64 towards a seated position in which injection of fuel through one or more spray holes (not shown) provided in the injector nozzle 62 to a combustion chamber (not shown) is prevented.

The injector 1 further comprises a control valve assembly 2, which controls movement of the injector needle 64. The control valve assembly 2 comprises a control valve body 6, a control valve member 4 which is reciprocally movable within a bore 8 provided in the control valve body 6, and a control chamber 40 located at an upper end of the bore 8. An actuator comprising an armature 70 is provided to control movement of the control valve member 4 between an open and a closed position.

Leakage of fuel within the control valve assembly 2 is a known problem. In particular; leakage can occur between the control valve member 4 and a guide portion of the bore 8 of the control valve body 6.

Increasing fuel pressure within the bore 8 causes the guide portion of the bore 8 to expand, thereby increasing clearance between the control valve member 4 and the control valve body 6, resulting in an increased leakage path. Increased leakage has a detrimental effect on the efficiency of the injector 1, for example by increasing the ratio of quantity of leaked fuel against quantity of injected fuel.

One solution to the problem of leakage along the guide portion of the bore is to reduce distortion of the control valve member and the control chamber. In the prior art control valve assembly 2 embodiment illustrated in FIG. 2, this is achieved by providing a pressure compensating chamber 80, defined by an outer annular recess of a sleeve or insert 82 located within the control valve body 6. It is necessary to provide an aperture 84 within the insert 82 to allow the high pressure fuel supply line 52 to communicate with the control chamber 40. Furthermore, precise machining of an upper internal frustoconical face 86 the insert 82, is required, as this face defines a valve seat for the control valve. In addition, installation of the insert 82 must be high precision, to avoid any leakage at the guide portions of the insert 82, thereby minimising distortion of the insert 82, whilst still enabling sufficient deformity of the insert 82 to provide the required compensation against pressure.

SUMMARY OF THE INVENTION

It is an object of the present invention to provide an improved control valve assembly incorporating an alternative, simpler and cheaper solution to minimise leakage between the control valve member and the bore of the body of the control valve.

Accordingly the present invention provides, in a first aspect, a subassembly according to claim 1.

When the subassembly and the control valve body are in the closed position, an axial distance from an end face of the control valve stem distal from the control chamber, to an end face of the sleeve proximate the control chamber, may be less than an axial distance from the end face of the control valve stem to a base of an entrance from the fuel passage to the control chamber, and an axial distance from the end face of the sleeve to the base of the entrance of the fuel passage greater than a distance of travel of the control valve member between an open and a closed position.

The stem may comprise at least one radial protrusion, wherein the protrusion contacts an inner surface of the sleeve.

The sleeve may be attached to the control valve member at least by a weld between an enlarged portion of the stem and a contact point on an inner surface of the stem.

Alternatively, the sleeve may be maintained in position on the control valve member by a sealing ring located in a groove recess provided on an enlarged portion of the stem.

In a further aspect, the present invention comprises a control valve assembly for a fuel injector, the control valve assembly comprising a control valve body and a subassembly as described above.

BRIEF DESCRIPTION OF THE DRAWINGS

The present invention is now described by way of example with reference to the accompanying drawings in which.

DESCRIPTION OF THE PREFERRED EMBODIMENTS

The present invention is described below in the orientation of the Figures; references to upper, lower, above and below are not intended to be limiting.

Figure 1:
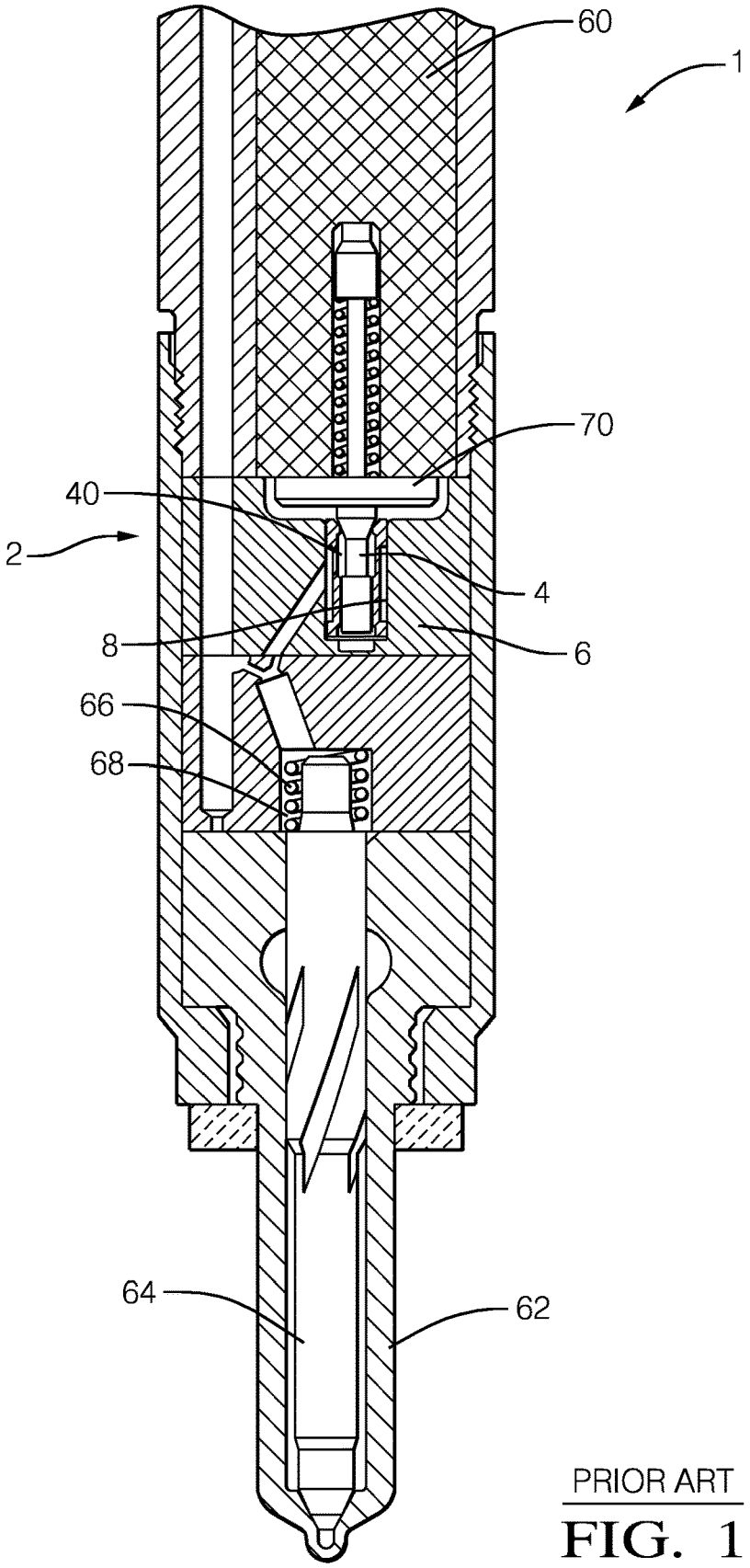
PRIOR ART FIG. 1
FIGS. 1 and 2 are cross-sectional views of a prior art fuel injector and a prior art control valve respectively.
Figure 2:
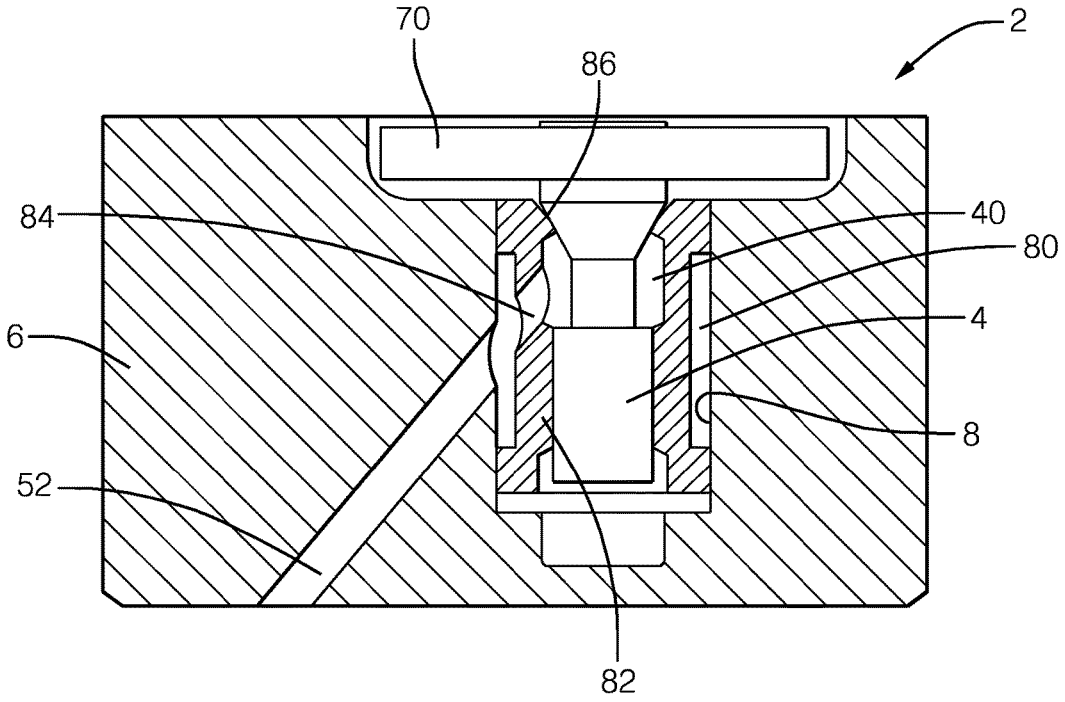
PRIOR ART FIG. 2
Figure 3:
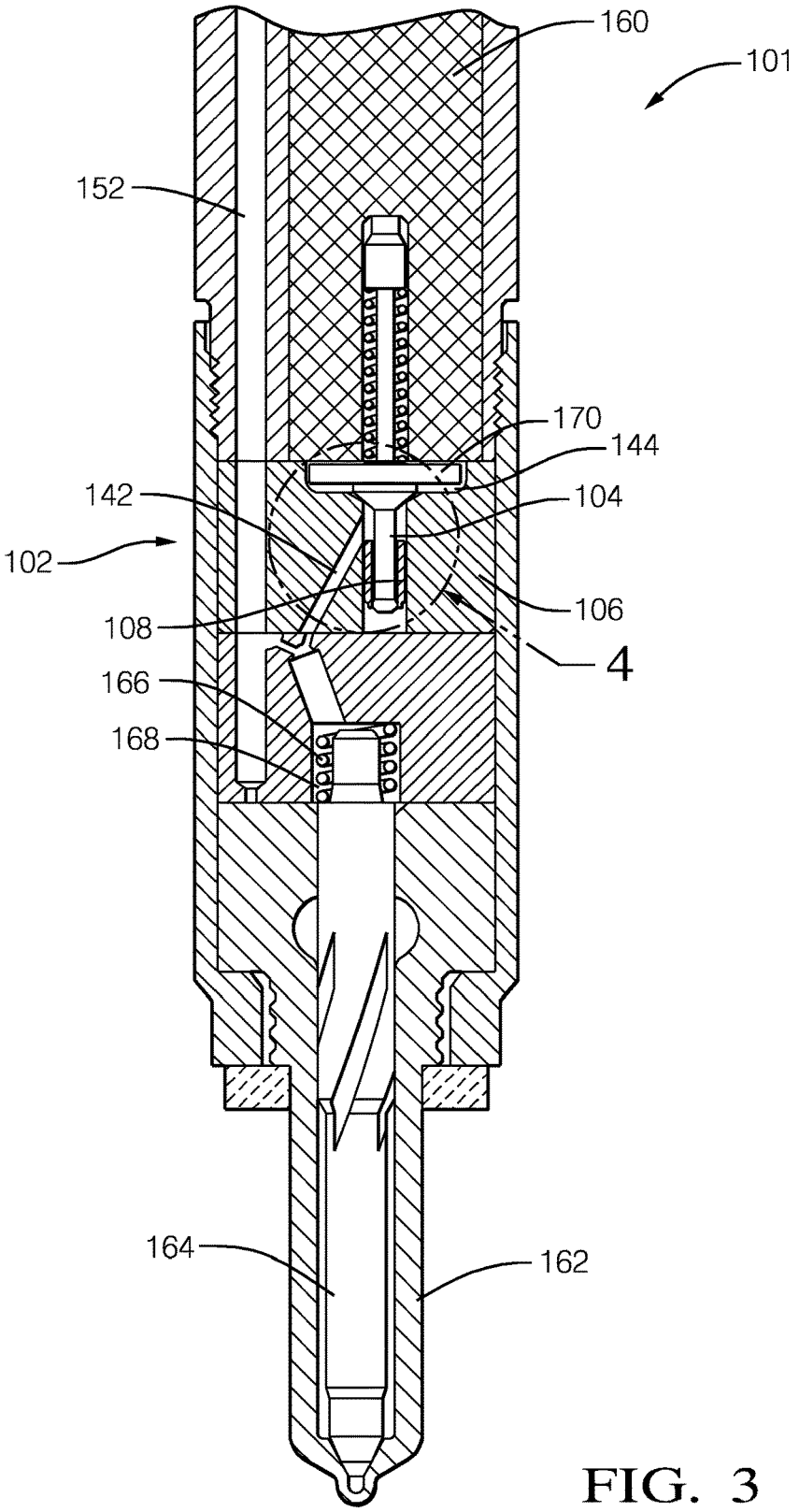
FIG. 3 is a cross-sectional view of an injector comprising a control valve subassembly in accordance with a first aspect of the present invention in a fuel injector.
Figure 4:
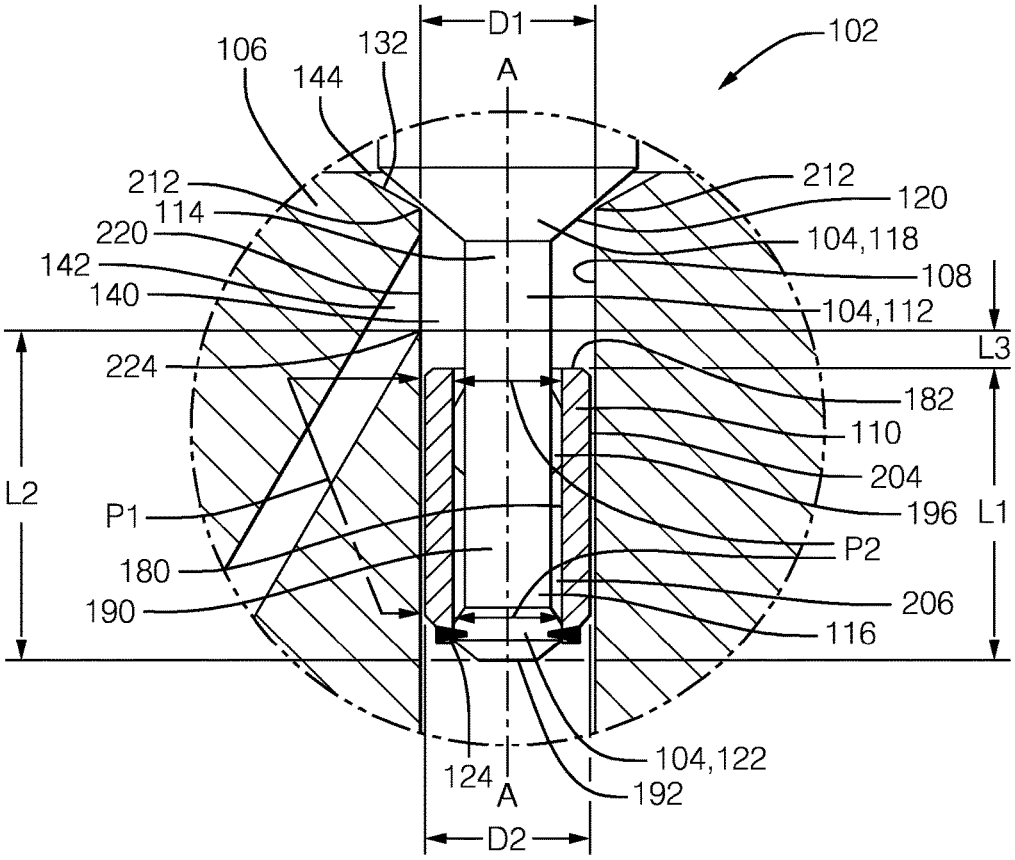
FIG. 4 is a partial cross-section view the control valve assembly of FIG. 3.

Referring to FIGS. 3 and 4, an injector 101 comprises an injector body 160, an injector nozzle 162, a movably mounted injector needle 164, and a control valve assembly 102.

The injector 101 has a longitudinal axis A; references to 'axial' and 'radial' below are in relation to the longitudinal axis A.

A spring 166 is provided in a spring chamber 168 for biasing the injector needle 164 towards a seated position in which injection of fuel through one or more spray holes (not shown) provided in the injector nozzle 162 to a combustion chamber (not shown) is prevented. Under the control of the control valve assembly 102, the injector needle 164 is moveable to an open position, wherein injection of fuel through the spray holes is enabled.

The control valve assembly 102, of the first embodiment of the present invention, as is illustrated in detail on FIG. 4, comprises a control valve body 106, a control valve member 104 which is reciprocally movable within a bore 108 provided in the control valve body 106, and a sleeve 110, attached to and movable with the control valve member 104.

The control valve member 104 comprises an elongate stem 112, and at a first, upper end 114, a frustoconical valve portion 118 comprising a contact face 120. At a second, lower end 116, remote from the first, upper end 114, the control valve member 104 comprises an enlarged portion 122.

A control chamber 140 is defined within an upper end of the bore 108, around an upper section 114 of the stem 112 of the control valve member 104. The actuator comprising an armature 170 controls relative movement of the control valve member 104 and the control valve body 106. In the embodiment illustrated in FIGS. 3 and 4, this relative movement comprises movement of the control valve member 104 within the control valve body 106, which remains stationary with respect to the rest of the injector 101. The control valve member 104 is movable between an open and a closed position, thereby to control movement of the injector needle 164.

A fuel supply line 152 supplies fuel from a high pressure fuel pump (not shown) to the injector nozzle 162 and the spring chamber 168. The control chamber 140 of the control valve assembly 102 is also in fluid communication with the fuel supply line 152, via a high pressure fuel passage 142.

At the top of the control chamber 140, proximate the armature 170, the control valve body 106 is provided with a frustoconical face 132. The control valve assembly 102 is shown in a fully closed position in FIGS. 3 and 4, wherein an annular seat 212 is formed, by contact between the contact face 120 of the frustoconical valve portion 118 of the control valve member 104, and the frustoconical face 132 of the control valve body 106. In the closed position, passage of fuel between the high pressure fuel passage 142 and a low pressure fuel return line 144, via the control chamber 140, is thereby prevented.

When the actuator is energised, the control valve member 104 is caused to move to an open position wherein a fluid pathway is enabled between the control chamber 140 and the low pressure fuel return line 144.

The control valve assembly 102 will now be described in greater detail.

The sleeve 110 is located around a lower section 190 of the elongate stem 112 of the control valve member 104.

An axial distance L1 from a lower end face 192 of the control valve stem 112 which is distal from the control chamber 140, to an end face 182 of the sleeve 110 proximate the control chamber 140, is less than an axial distance L2 from the end face 192 of the control valve stem 112 to a base 224 of an entrance 220 from the high pressure fuel passage 142 to the control chamber 140. The sleeve 110 therefore does not obstruct the flow of fuel from the high pressure fuel passage 142 into the control chamber 140 when the control valve member 104 is in the closed position as shown in FIG. 4.

Furthermore, an axial distance L3 between the upper end face 182 of the sleeve 110, to the base 224 of the entrance 220 of the high pressure fuel passage 142, is equal to, or less than, the travel of the control valve member 104 (i.e. the distance the control valve member 104 moves between the open and closed positions), such that the sleeve 110 also does not obstruct the entrance 220 when the control valve member 104 is in the open position.

However, in alternative embodiments of the present invention, L3 could be slightly greater than the travel of the control valve member 104, provided that any obstruction of the high pressure fuel passage 142 by the sleeve 110 when the control valve member is in the open position is sufficiently small so as to prevent any significant loss of pressure of fuel flowing through the entrance.

Ideally, when the control valve member 104 is in the open position, the remaining effective cross-sectional area of the entrance 220 (i.e. taking into account any obstruction by the sleeve 110) should be at least ten times greater than the cross-sectional area of the flow of fuel between the seat 212 and the frustoconical valve portion 118 of the control valve member 104 (i.e. towards the low pressure fuel return line 144).

The external diameter D2 of the sleeve 110 is the same as the diameter D1 of the annular seat 212. In an alternative embodiment, the diameter D1 of the annular seat 212 could be slightly larger than the diameter D2 of the sleeve 110, thereby creating a small pressure unbalance, which is still manageable by virtue of the control valve spring 66.

A clearance 206 is provided by a gap between the sleeve 110 and the control valve member 104 along a substantial part of the length of the sleeve 110.

During assembly of the control valve assembly 2, the sleeve 110 is press fitted onto the over the second, lower end 116 the stem 112 of the control valve member 104 to form a subassembly. At a contact point between a part of an inner surface 180 of the sleeve 110, and the enlarged portion 122 of the control valve member 104, a tight seal is obtained. This seal may be strengthened, for example by a laser weld 124.

Figure 7:
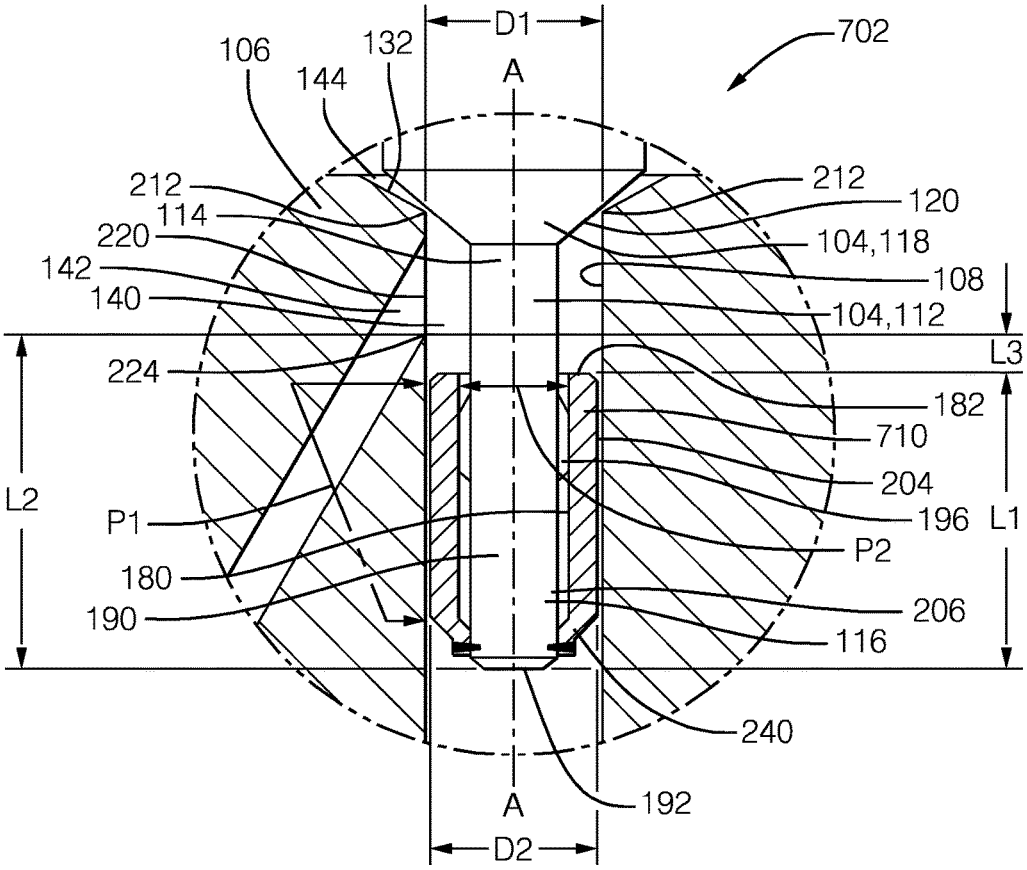
FIG. 7 is a cross-sectional view of a control valve assembly incorporating a subassembly in accordance with a fourth embodiment of the present invention.

In an alternative embodiment of control valve assembly 702 in accordance with the present invention, as illustrated in FIG. 7, the enlarged portion of the stem 122 is not present, i.e. the stem 122 is of a constant diameter, and a reduced diameter portion 240 is provided at the end of the sleeve 710 furthest away from the frustoconical valve portion 118. A tight seal as defined above is created between the stem 122 and the inner surface 180 of the sleeve 710 in the reduced diameter portion 240.

The subassembly comprising the control valve member 104 and the sleeve 110 is then inserted into the bore 108 of the control valve body 106 from the top of the bore 108.

The stem 112 of the control valve member 104 may optionally include a radial protrusion 196, at a mid-point of the stem 112, but axially below the upper end face 182 of the sleeve 110. The protrusion 196, as illustrated on FIG. 4, contacts the inner surface 180 of the sleeve 110, and acts as a centering feature, to ensure maintain concentricity between the sleeve 110 and the stem 112 of the control valve member 104.

The protrusion 196 is not annular, such that a fluid pathway between the control chamber 140 and the clearance 206 between the sleeve 110 and the control valve member 104 is maintained along a substantial part of the length of the sleeve 110.

The sleeve 110 of the second embodiment can either be freely assembled or press fitted over the second, lower end 116 of the control valve member 104.

During use of the injector 101, as high pressure fuel flows into the control chamber 140 via the high pressure fuel passage 142, and a leak flow of fuel flows on between an outer surface 204 of the sleeve 110, and the bore 108 of the control valve body 106.

The leakage flow of fuel between the sleeve 110 and the bore 108 is subject to a pressure gradient P1, as illustrated schematically on FIG. 4; fuel pressure decreases along the direction of flow, moving away from the entrance 220 of the high pressure fuel passage 142, i.e. from the top of the sleeve 110 to the bottom in the orientation shown in FIG. 4. Due to the pressure gradient, an inward axial force applied to the sleeve 110 by the pressure of fuel between the sleeve 110 and the bore 108, decreases from the top to the bottom of the sleeve 110, i.e. moving away from the entrance 220 of the high pressure fuel passage 142.

Fuel also enters the clearance between the inner surface 180 of the sleeve 110, and the stem 112 of the control valve member 104. There is no flow of fuel within the clearance, however fuel in the clearance enables pressure to be exerted on the entire inner surface 180 of the sleeve 110. The pressure of the fuel between the sleeve 110 and stem 112 (e.g. at points P2 on FIG. 4), is constant along the axial length of the sleeve 110 (the fuel pressure), and therefore exerts a constant outward axial force on the inner surface 180 of the sleeve 110 along the length of the sleeve 110.

As the outward axial force applied to the sleeve 110 by fuel pressure is greater than the inward axial force, the net outward axial force causes the sleeve 110 to slightly expand as inlet fuel pressure increases. The clearance 206 between the sleeve 110 and the stem 112 of the control valve member 104 thereby provides a pressure compensation.

The bore 108 of the control valve body 106 also expands/dilates, i.e. diameter D1 increases, as a result of increasing pressure within the control chamber 140, and within the clearance between the bore 108 and the external surface 204 of the sleeve 110. However, as the body 106 dilates due to increasing pressure, the sleeve 110 expands to fit the expanded body 106, i.e. the external diameter of the sleeve 110 further increases such that the clearance between the sleeve 110 and the body 106 reduces. Accordingly, the pressure within the clearance does not increase as pressure within the control chamber 140 increases.

The expansion of the sleeve 110 as inlet fuel pressure increases urges the outer surface 204 of the sleeve 110 into closer contact with the bore 108, thereby further decreasing, or eliminating any leak flow path between the sleeve 110 and the bore 108.

The thickness of the sleeve 110 can be selected to provide a required compensation against fuel pressure.

Figure 5:
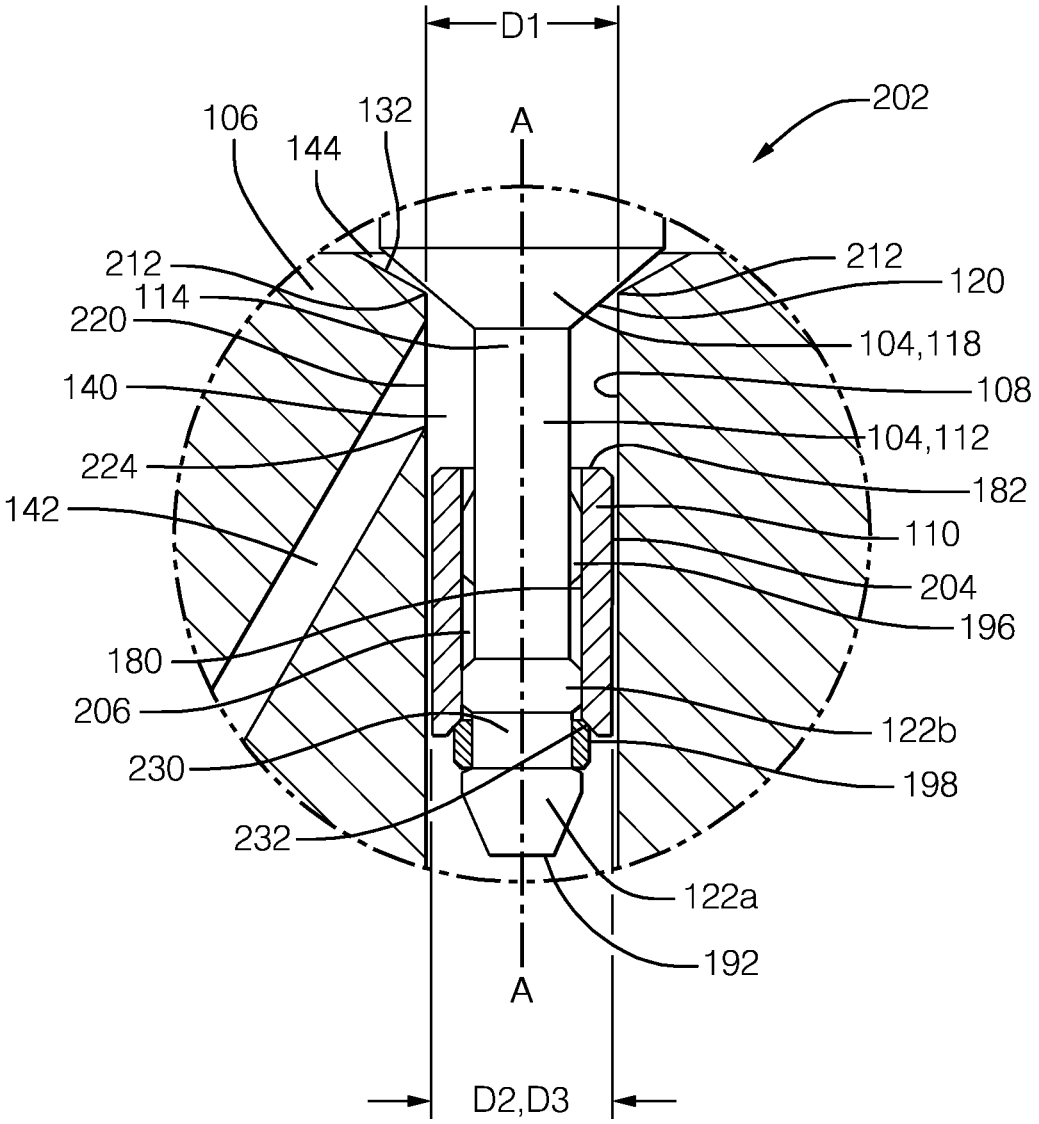
FIG. 5 is a partial cross-sectional view of a control valve assembly incorporating a subassembly in accordance with a second embodiment of the present invention.

In a control valve assembly 202 in accordance with a second embodiment of the present invention, as illustrated in FIG. 5, the sleeve 110 is maintained in position on the control valve member by a sealing ring 198, which is press fitted on the stem 112 and is secured in a matching annular groove recess 230 provided in the enlarged portion 122 of the control valve member 104. The enlarged portion 122 of the control valve member 104 of the second embodiment therefore comprises two sections; a first section 122*a* above the groove recess 230, and a second section 122*b* below the groove recess 230.

A frustoconical surface is provided at the lower end of the inner surface 180 of the sleeve 110, and a cooperating frustoconical surface is provided on the outer diameter of the sealing ring 198. A seal is obtained between the sleeve 110 and the control valve member 104 by axial loading between the sealing ring 198 and a contact point 232 between the frustoconical surfaces of the inner surface 180 of the sleeve 110 and that of the sealing ring 198.

Figure 6:
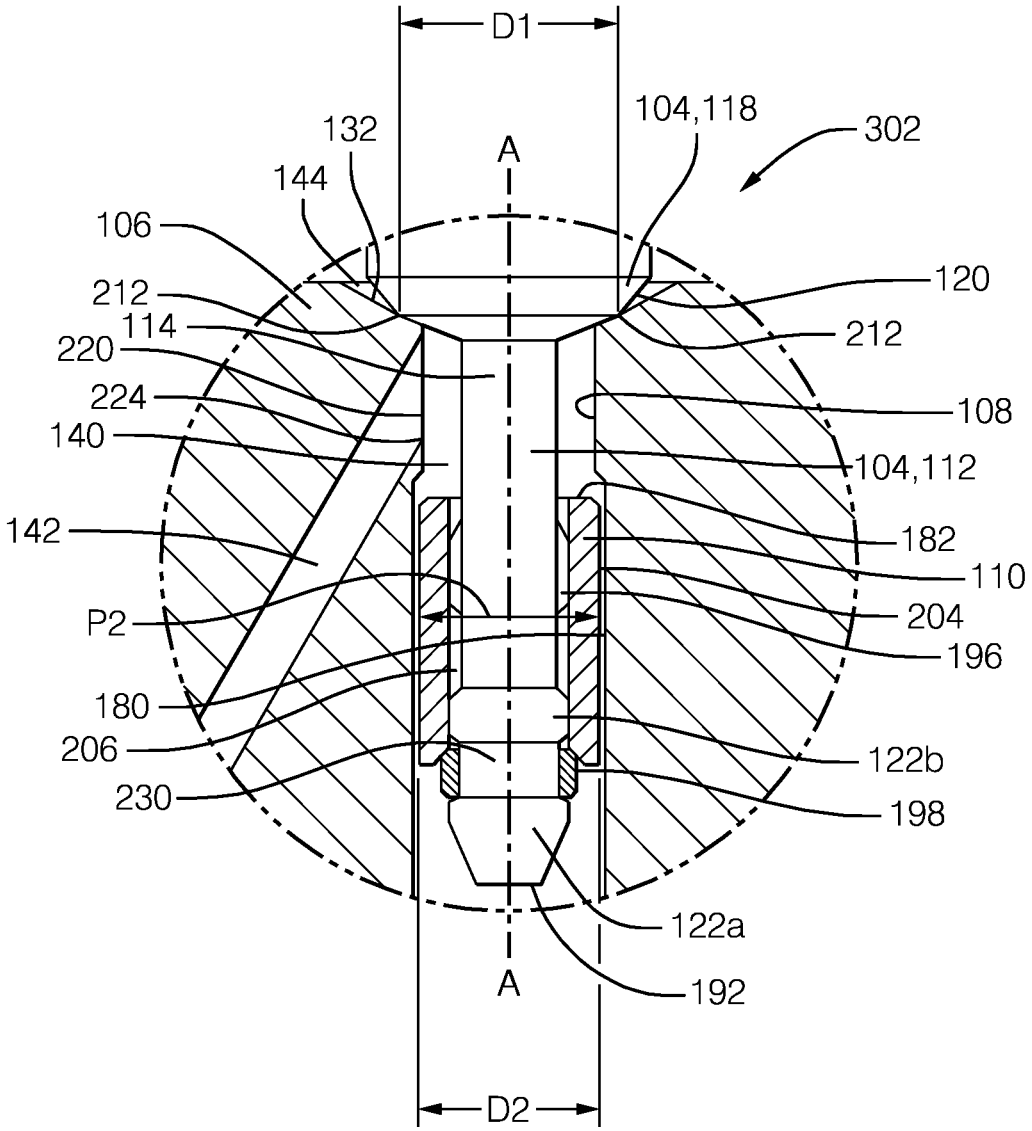
FIG. 6 is a partial cross-sectional view of a control valve assembly incorporating a subassembly in accordance with a third embodiment of the present invention.

A control valve assembly 302 in accordance with a third embodiment of the present invention is illustrated in FIG. 6. In the third embodiment, the diameter D1 of the annular seat 212 can be slightly larger or slightly smaller than the external diameter D2 of the sleeve 110.

To enable the third embodiment of the present invention, the external diameter D2 of the sleeve 110 is matched to the diameter D3 of the bore by a selected machining operation.

Assembly of a control valve assembly 302 in accordance the third embodiment of the present invention comprises:

- assembling the stem 112 of the control valve member 106 from the top of the control valve body 106;
- fitting the sleeve 110 over the stem 112 within the bore 108 of the control valve body 106;
- inserting a locking sealing ring 198 into a matching annular groove recess 230, thereby by secure the sleeve 110 axially.

In a control valve assembly according to the third embodiment of the present invention, the seat 212 can be at a greater radial distance away from the bore 108, thereby increasing the strength and reliability of the seat 212.

Compared to the prior art embodiment above, the present invention provides an advantage in terms of managing the bearing surface. Locating the seat 212 further away from the intersection of the bore 108 and frustoconical face 132 of the control valve body 106 provides a large reliability improvement as discussed above. The diameter of the seat 212 can be further enlarged, whilst still maintaining a balanced effect when D1 is equal to D2, with very small leakage by virtue of the pressure compensation effect of the sleeve 110.

A further key advantage of the present invention is compatibility with existing control valve bodies; a subassembly comprising the control valve member and sleeve of the present invention can be easily assembled into the bore of an existing control valve body.

Furthermore, a sleeve 110, or sleeve 110 and control valve member 104 subassembly, or a control valve assembly 102, 202, 302 in accordance with the present invention can be retrofitted to alternative embodiments of injector.

Figure 8:
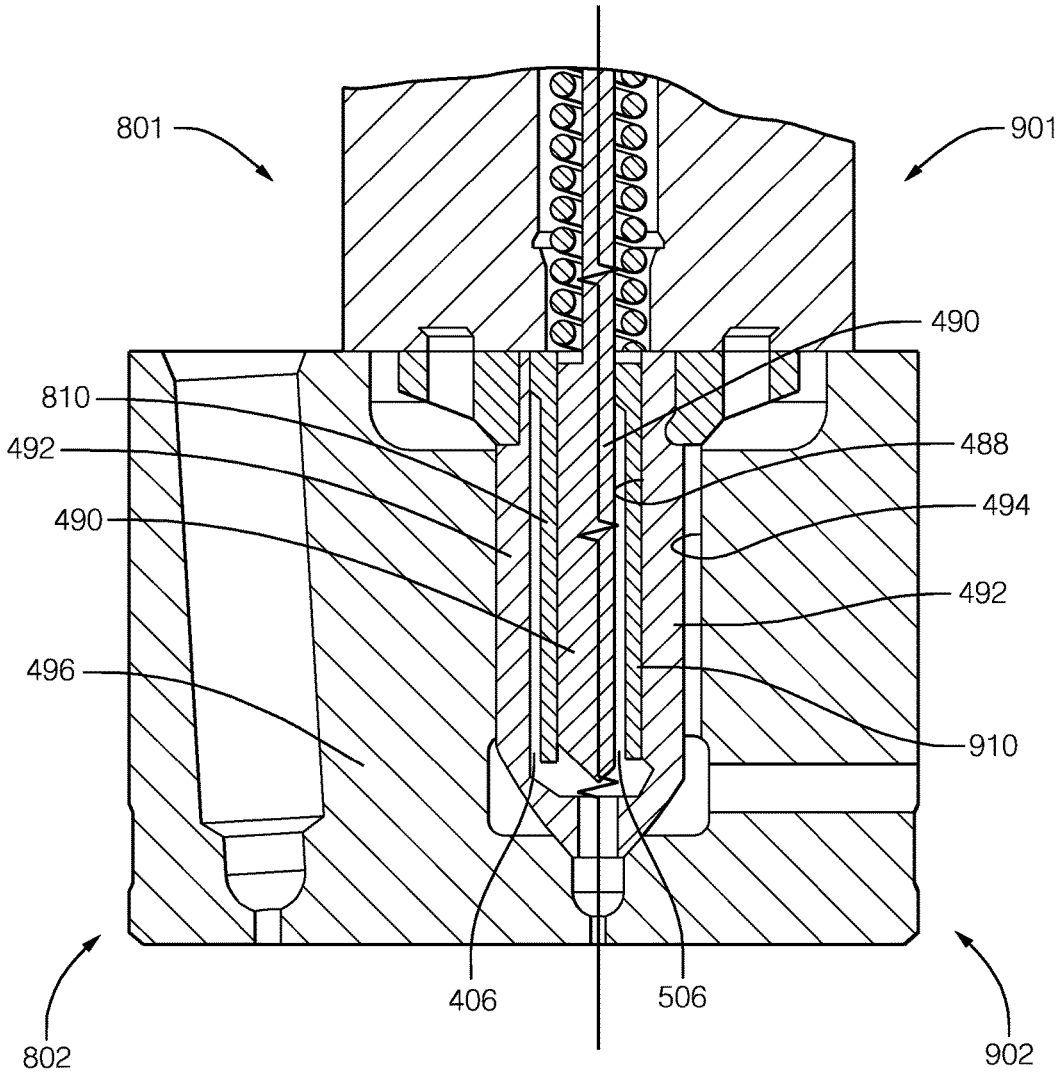
FIG. 8 is a cross-sectional partial view of two injectors incorporating subassemblies in accordance with the present invention.

For example, FIG. 8 illustrates two variations, 801 and 901, of known injectors.

The left hand side of FIG. 8 illustrates the first known injector 801, incorporating a sleeve 810 in accordance with the present invention in a control valve assembly 802. The control valve assembly 802 comprises a control valve member in the form of a central pin 490, which is received in a bore 488 provided in a valve stem 492. The valve stem 492 therefore effectively forms a control valve body.

The valve stem 492 is located within a further bore 494 provided in a control valve block 496. The valve stem 492 is slidable within the further bore 494, such that the valve stem 492 is moveable with respect to the central pin 490 and with respect to the control valve block 496.

The sleeve 810 is located between the central pin 490 and the valve stem 492, and is secured to the valve stem 492 at one end of the valve stem 492. The sleeve 810 is shaped such that a clearance 406 is provided between the sleeve 810 and the valve stem 492. As high pressure fuel enters the clearance 406, the pressure compensating principal works as described above in respect of the first to third embodiments. Leakage is minimized between the sleeve 810 and the central pin 490.

The right hand side of FIG. 8 illustrates the second known injector 901, incorporating a sleeve 910 in accordance with the present invention in a control valve assembly 902. Similarly to the left hand side embodiment, the sleeve 910 is located between the central pin 490 and the valve stem 492. However, the sleeve 910 is fixed to the central pin 490 rather than the valve stem 492, and thereby remains stationary as the valve stem 492 moves around it. A clearance 506 is provided between the sleeve 910 and the central pin 490, and as high pressure fuel enters the clearance 506, the pressure compensating principle works in the same manner as described in respect of the first to third embodiments as above.

REFERENCES injector 101, 801, 901
control valve assembly 102, 202, 302, 702, 802, 902
control valve member 104
control valve body 106
bore 108
sleeve 110, 410, 510, 710, 810, 910
control valve member stem 112
stem first, upper end 114
stem second, lower end 116
control valve frustoconical valve portion 118
valve portion contact face 120
control valve member enlarged portion 122
enlarged portion first section 122*a*
enlarged portion second section 122*b*
weld 124
upper end frustoconical face 132
control chamber 140
high pressure fuel passage 142
low pressure fuel return line 144
actuator 148
fuel supply line 152
injector body 160
injector nozzle 162
injector needle 164
spring 166
spring chamber 168
armature 170
sleeve inner surface 180
sleeve upper end face 182
stem lower section 190
stem lower end face 192
control valve member protrusion 196
sealing ring 198
sleeve outer surface 204
clearance 206, 406, 506
annular seat 212
HP fuel passage entrance 220
HP fuel pressure passage entrance base 224
enlarged portion groove recess 230
sleeve lower internal surface 232
sleeve reduced diameter portion (FIG. 7) 240
valve stem bore 488
central pin 490
valve stem 492
control valve block bore 494
control valve block 496
annular seat diameter D1
sleeve external diameter D2
bore diameter D3
pressure gradient P1

The invention claimed is:

1. A subassembly for a control valve for a fuel injector; the subassembly comprising a control valve member and a sleeve attached to a stem of the control valve member;
wherein the subassembly is located within a bore of a control valve body, and wherein the subassembly and the control valve body are arranged for relative movement with one another, between a closed position, wherein a flow of fuel between a fuel passage and a fuel return line via a control chamber is prevented, and an open position, wherein the flow of fuel is enabled;
wherein the sleeve extends along at least a partial axial length of the stem of the control valve member;
and wherein a clearance, provided between the sleeve and the control valve member, is in fluid communication with the control chamber.

2. A subassembly as claimed in claim 1 wherein, when the subassembly and the control valve body are in the closed position, an axial distance from an end face of the stem distal from the control chamber, to an end face of the sleeve proximate the control chamber, is less than an axial distance from the end face of the stem to a base of an entrance from the fuel passage to the control chamber,
and wherein an axial distance from the end face of the sleeve to the base of the entrance of the fuel passage, is greater than a distance of travel of the control valve member between the open position and the closed position.

3. A subassembly as claimed in claim 2 wherein the stem comprises at least one radial protrusion, wherein the at least one protrusion contacts an inner surface of the sleeve.

4. A subassembly as claimed in claim 2 wherein the sleeve is attached to the control valve member at least by a weld between an enlarged portion of the stem and a contact point on an inner surface of the stem.

5. A subassembly as claimed in claim 2 wherein the sleeve is maintained in position on the control valve member by a sealing ring located in a groove recess provided on an enlarged portion of the stem.

6. A subassembly as claimed in 1 wherein the stem comprises at least one radial protrusion, wherein the at least one protrusion contacts an inner surface of the sleeve.

7. A subassembly as claimed in claim 1 wherein the sleeve is attached to the control valve member at least by a weld between an enlarged portion of the stem and a contact point on an inner surface of the stem.

8. A subassembly as claimed in claim 1 wherein the sleeve is maintained in position on the control valve member by a sealing ring located in a groove recess provided on an enlarged portion of the stem.

9. A subassembly as claimed in claim 1 wherein:
the control valve member includes a control valve member face;
the control valve body includes a control valve body face;
relative movement of the subassembly and the control valve body to the closed position causes the control valve member face to engage the control valve body face such that engagement of the control valve member face with the control valve body face prevents flow of fuel between the fuel passage and the fuel return line via the control chamber; and relative movement of the subassembly and the control valve body to the open position causes the control valve member face to be spaced apart from the control valve body face such that spacing apart of the valve member face from the control valve body face enables flow of fuel between the fuel passage and the fuel return line via the control chamber.

10. A subassembly as claimed in claim 1 wherein the sleeve is moveable with the valve member and relative to the control valve body during relative movement of the subassembly and the control valve body.

11. A control valve assembly for a fuel injector, the control valve assembly comprising:

a control valve body; and a subassembly comprising a control valve member and a sleeve attached to a stem of the control valve member;

wherein the subassembly is located within a bore of a control valve body, and wherein the subassembly and the control valve body are arranged for relative movement with one another, between a closed position, wherein a flow of fuel between a fuel passage and a fuel return line via a control chamber is prevented, and an open position, wherein the flow of fuel is enabled;

wherein the sleeve extends along at least a partial axial length of the stem of the control valve member;

and wherein a clearance, provided between the sleeve and the control valve member, is in fluid communication with the control chamber.

12. A control valve assembly as claimed in claim 11 wherein, when the subassembly and the control valve body are in the closed position, an axial distance from an end face of the stem distal from the control chamber, to an end face of the sleeve proximate the control chamber, is less than an axial distance from the end face of the stem to a base of an entrance from the fuel passage to the control chamber, and wherein an axial distance from the end face of the sleeve to the base of the entrance of the fuel passage, is greater than a distance of travel of the control valve member between the open position and the closed position.

13. A control valve assembly as claimed in claim 12 wherein the stem comprises at least one radial protrusion, wherein the at least one protrusion contacts an inner surface of the sleeve.

14. A control valve assembly as claimed in claim 12 wherein the sleeve is attached to the control valve member at least by a weld between an enlarged portion of the stem and a contact point on an inner surface of the stem.

15. A control valve assembly as claimed in claim 12 wherein the sleeve is maintained in position on the control valve member by a sealing ring located in a groove recess provided on an enlarged portion of the stem.

16. A control valve assembly as claimed in 11 wherein the stem comprises at least one radial protrusion, wherein the at least one protrusion contacts an inner surface of the sleeve.

17. A control valve assembly as claimed in claim 11 wherein the sleeve is attached to the control valve member at least by a weld between an enlarged portion of the stem and a contact point on an inner surface of the stem.

18. A control valve assembly as claimed in claim 11 wherein the sleeve is maintained in position on the control valve member by a sealing ring located in a groove recess provided on an enlarged portion of the stem.

19. A control valve assembly as claimed in claim 11 wherein the control valve member includes a control valve member face;

the control valve body includes a control valve body face;

relative movement of the subassembly and the control valve body to the closed position causes the control valve member face to engage the control valve body face such that engagement of the control valve member face with the control valve body face prevents flow of fuel between the fuel passage and the fuel return line via the control chamber; and relative movement of the subassembly and the control valve body to the open position causes the control valve member face to be spaced apart from the control valve body face such that spacing apart of the valve member face from the control valve body face enables flow of fuel between the fuel passage and the fuel return line via the control chamber.

20. A control valve assembly as claimed in claim 11 wherein the sleeve is moveable with the valve member and relative to the control valve body during relative movement of the subassembly and the control valve body.

* * * * *